US008097326B2

(12) United States Patent
Wunderlich

(10) Patent No.: US 8,097,326 B2
(45) Date of Patent: Jan. 17, 2012

(54) STACK COMPRISING MULTI-FOLDED FOUR PANEL SHEETS AND FOLDING BOARDS THEREFOR

(75) Inventor: John H. Wunderlich, Green Bay, WI (US)

(73) Assignee: Paper Converting Machine Company, Green Bay, WI (US)

( * ) Notice: Subject to any disclaimer, the term of this patent is extended or adjusted under 35 U.S.C. 154(b) by 452 days.

(21) Appl. No.: 12/258,639

(22) Filed: Oct. 27, 2008

(65) Prior Publication Data

US 2010/0104799 A1 Apr. 29, 2010

(51) Int. Cl.
*B32B 3/04* (2006.01)

(52) U.S. Cl. ..... 428/126; 428/130

(58) Field of Classification Search ..... 428/126, 428/130; 221/48; 206/494
See application file for complete search history.

(56) References Cited

U.S. PATENT DOCUMENTS

| | | | |
|---|---|---|---|
| 3,207,360 | A | 9/1965 | Scott |
| 3,401,928 | A | 9/1968 | Frick |
| 3,462,043 | A | 8/1969 | Frick |
| 4,138,034 | A | 2/1979 | McCarthy |
| 4,502,675 | A | 3/1985 | Clark et al. |
| 5,497,903 | A | 3/1996 | Yoneyama |
| 6,045,002 | A | 4/2000 | Wierschke |
| 6,168,848 | B1 | 1/2001 | Heath |
| 6,286,712 | B1 | 9/2001 | Craig |
| 6,641,894 | B2 | 11/2003 | Bando |
| 6,740,021 | B2 | 5/2004 | Evans |
| 7,322,489 | B2 | 1/2008 | Long |
| 2004/0115393 | A1 | 6/2004 | Vogel et al. |

FOREIGN PATENT DOCUMENTS

| | | |
|---|---|---|
| EP | 0 978 247 A1 | 2/2000 |
| EP | 1 188 404 A2 | 3/2002 |

*Primary Examiner* — Alexander Thomas
(74) *Attorney, Agent, or Firm* — Greer, Burns & Crain, Ltd.

(57) ABSTRACT

A stack of folded sheets comprises first and second groups of folded sheets. Each of the sheets if each group includes a center panel, it second panel, and a V-shaped portion including third and fourth panels. The sheets of the two groups are alternately arranged so that the second panel of each sheet of each group is adjacent a fourth panel of a sheet of the other group. The adjacent second and fourth panels may or may not be interleaved.

Adjustable folding boards are provided for folding elongated webs into the first and second folded sheets. Each of the folding boards includes a slidably mounted first plate which folds the fourth panel of the folded sheet. A second plate extends downwardly from the first plate and is also slidably mounted for movement transversely to the web. Third and fourth plates are mounted in front of the second plate.

Adjusting the first and second plates relative to the web changes the width of the fourth panel. Adjusting the third panel relative to the web changes the widths of the central panel and the third panel. Adjusting the fourth plate relative to the web changes the widths of the central panel and the second panel.

19 Claims, 13 Drawing Sheets

INVERTED

INVERTED OPPOSITE HAND

STACK COMPRISING MULTI-FOLDED FOUR PANEL SHEETS AND FOLDING BOARDS THEREFOR

BACKGROUND

This invention relates to folded sheets of paper tissue or similar material, which are sometimes called wipes. More specifically, the invention relates to a balanced stack of interfolded sheets wherein removal of the top sheet moves the next sheet into position for removal.

The final product is normally a stack of interfolded sheets that are stored in a container or dispenser which allows for a single sheet to be removed. The sheets are commonly constructed of materials such as papers, non-wovens, air laids, melt-blown, and spunlaced fabrics. The sheets can be either wet or dry.

Products that have narrower folded widths are commercially attractive due to shelf space limitations. However, narrow folded widths can be difficult to achieve with wide or medium width open sheets due to ply buildup in the stack. The ply buildup causes lumps in the stack that make it difficult to process and package the stack on automated equipment.

The prior art describes various types of folded sheets for forming stacks of sheets. For example, U.S. Pat. No. 3,207,360 describes a package of interleaved Z folded sheets.

U.S. Pat. No. 3,401,928 describes a stack of interleaved sheets in which each sheet includes two quarter folds on the top and a half-width fold on the bottom (FIG. 9). Adjacent sheets are folded in opposite directions so that the stack is balanced. The patent also describes folding boards or plates for folding the sheets.

U.S. Pat. No. 4,138,034 describes a package of premoistened interleaved sheets. The sheets may have alternating V folds, or alternating Z folds.

U.S. Pat. No. 4,502,675 describes W folded sheets having four panels of equal width and also describes folding boards or plates.

U.S. Pat. No. 6,045,002 describes a stack of right and left V folded sheets which are alternately interleaved with right and left Z folded sheets and also describes folding boards or plates.

U.S. Pat. No. 6,168,848 describes a stack of interleaved W folded sheets and Z folded sheets.

U.S. Pat. No. 6,641,894 describes a stack of interleaved W folded sheets.

U.S. Pat. No. 6,740,021 describes folding boards for making V folded sheets.

U.S. Pat. No. 7,322,489 describes sheets which are Z folded, V folded, and C folded.

Despite the foregoing prior art, there is still a need in the wipes market for a stack of wide or medium width sheets or wipes which are folded down to a narrow folded width with no ply buildup across the width of the folded stack. For example, a common open width of sheet is 200 mm. The minimum stack width for a sheet of that width that is folded in accordance with the modified V fold of U.S. Pat. No. 5,497,903 is about 108 mm. The minimum stack width for a 200 mm sheet that is folded in accordance with the V-Z fold of U.S. Pat. No. 6,045,002 is about 109 mm. Ribbon weave and stacker tolerances could also add to the stack width. Many customers prefer a narrower stack width.

SUMMARY OF THE INVENTION

The invention provides a novel fold which enables a sheet of wide or medium width to be folded into a narrow stack width. The stack has consistent sheet location for ease of starter dispensing, symmetrical stack design allowing for top or bottom dispensing, and single sheet pull up tab, all without undesirable ply buildup in the folded stack.

For example, the inventive fold enables folding of a 200 mm wide sheet down to a stack width or folded width of about 87 mm. If desired, the 200 mm wide sheet can be folded to a folded width of greater than 87 mm.

The folded sheet includes four panels, including a center panel which defines the width of the stack. A second or bottom panel extends from one edge of the center panel below the center panel, and a V-folded top portion extends from the other edge of the center panel above the center panel and includes third and fourth panels. Alternatively, the second panel can extend above the center panel and the V-folded portion can extend below the center panel.

A stack is formed from two groups of sheets. The sheets of one group are the mirror images of the sheets of the other group. The sheets can be interleaved or not interleaved.

In the preferred embodiment, the inner edge of the second panel does not overlap the inner edge of the V-folded top portion and neither of the edges crosses over the center of the center panel. This provides the maximum width product with the most uniform layer concentration with no air gaps. However, in other embodiments the second panel and the inner edge of the V-fold cross the center of the center panel and overlap. As narrower products are run at the same stack width, the amount of overlap between the second panel and the V-folded portion can be reduced or the gap between the second panel and the V-folded portion can be widened.

The invention also provides novel adjustable folding boards or plates for forming the two groups of folded sheets. Each folding board includes movable plates which permit the width of each of the four panels of each sheet to be adjusted as desired.

DESCRIPTION OF THE DRAWING

The invention will be explained in conjunction with specific embodiments which are illustrated in the accompanying drawing, in which.

DESCRIPTION OF SPECIFIC EMBODIMENTS

Figure 1:
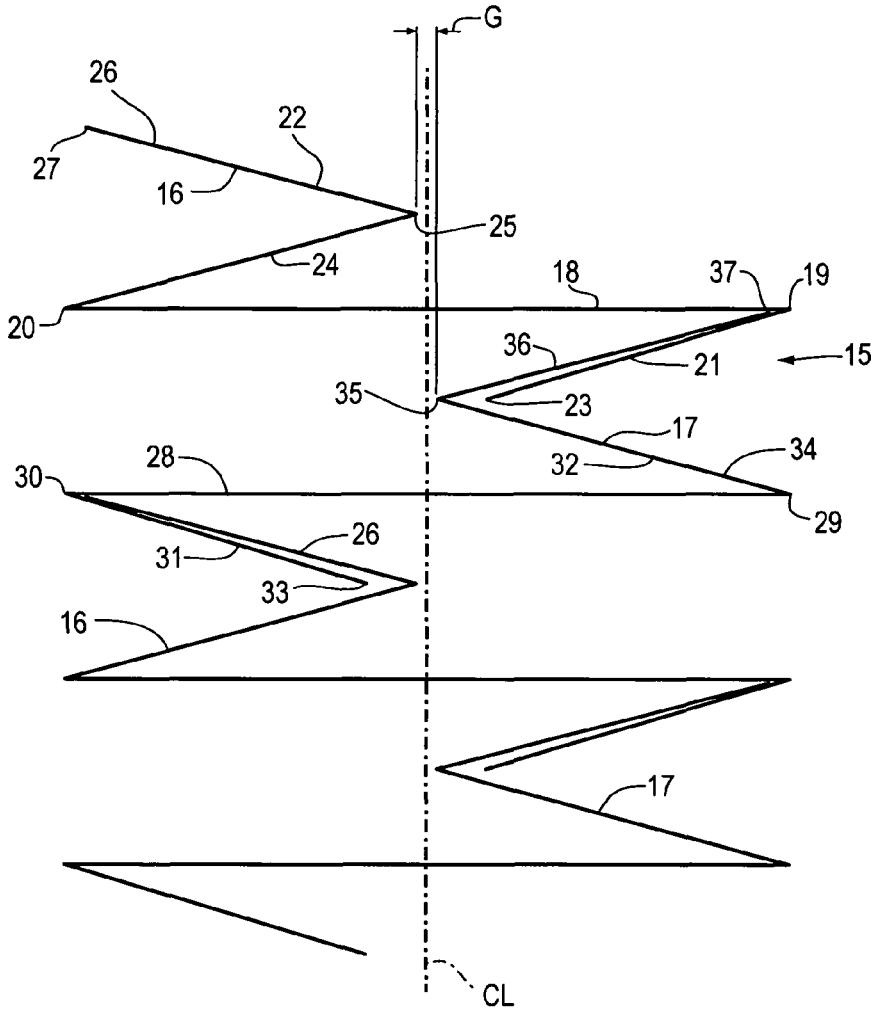
FIG. 1 is an end view of a partial stack of sheets which are folded in accordance with the invention.

Referring to FIG. 1, a stack 15 of sheets is formed from two groups of folded sheets—left facing folded sheets 16 and right facing folded sheets 17. Each left facing sheet 16 includes a center panel 18 having right and left edges 19 and 20 which define the width of the center panel, a second or bottom panel 21, and a V-folded top portion 22 on the left side of the center panel. The second panel 21 extends below the center panel from the right edge 19 of the center panel and terminates in an inner edge 23. The V-folded top portion 22 includes a third panel 24 which extends above the center panel from the left edge 20 of the center panel and terminates in an inner folded edge 25 and a fourth panel 26 which extends above the panel 24 from the edge 25 and terminates in an outer edge 27.

Each right facing sheet 17 is the mirror image of the left facing sheets 16 and includes a center panel 28 having right and left edges 29 and 30, a second or bottom panel 31 on the left side of the center panel, and a V-folded top portion 32 on the right side of the center panel. The second or bottom panel 31 extends below the center panel 28 from the left edge 30 of the center panel and terminates in an inner edge 33. The V-folded top portion 32 includes a third panel 34 which extends above the center panel 28 from the right edge 29 of the center panel and terminates in a inner folded edge 35 and a fourth panel 36 which extends above the panel 34 from the edge 36 and terminates in an outer edge 37.

The stack 15 shown in FIG. 1 is a partial stack which includes two left facing sheets 16 and two right facing sheets 17 which are alternately arranged in the stack. However, it will be understood that a stack will generally include a greater number of sheets 16 and 17 which are alternately arranged to form the stack.

In the embodiment illustrated in FIG. 1, the alternating left and right sheets are interfolded or interleaved. The bottom panel 21 of each left facing sheet 16 underlies the fourth panel 36 of the adjacent lower right facing sheet 17. The bottom panel 31 of each right facing sheet 17 underlies the fourth panel 26 of the adjacent lower left facing sheet. It will be understood that bottom panel of the last sheet of the stack is not interleaved since there is no sheet below that bottom panel.

When the stack is contained in a conventional container or package, the interleaving of the sheets assures that when the top sheet is removed from the container, the next sheet will "pop-up" or move into position for removal. The top panel 26 or 36 of the V-folded portion of the next sheet will advantageously be partially withdrawn through the opening of the container so that it can be easily grasped for later removal.

As will be explained hereinafter, the alternating sheets can also be placed on top of each other without interleaving.

Although each of the left and right sheets includes four panels, the inventive fold is different than prior W folds which included four equal width panels or two equal width center panels. The width of the center panels 18 and 28 defines the width of the stack, and the bottom panel and V-folded top panels of each sheet extend below and above, respectively, the center panel. The inventive fold can be described as a J-Z fold—the center panel (18, 28), the bottom panel (21, 31), and the lower half of the upper V-folded portion (24, 34) form a Z fold, and the upper half of the V-folded portion (26, 36) can be considered as generally J-shaped on top of the Z fold. The term "left facing sheet" with respect to the sheet 16 refers to the direction in which the J portion 26 extends or the direction in which the V-shaped portion 22 opens. Similarly, the term "right facing sheet" with respect to the sheet 17 refers to the direction in which the J portion 36 extends or the direction in which the V-shaped portion 32 opens.

In FIG. 1 the right and left edges of the center panels 18 and 28 are vertically aligned, and a center line CL bisects the center panels and the stack. In the preferred embodiment of FIG. 1, the folded edges 25 and 35 of the V-folded portions 22 and 32 are spaced to the left and right, respectively, of the center line, i.e., the edges of the V-folds do not cross over the center of the stack and do not overlap. The space G between the edges 25 and 35 of the V-folds is referred to as the center fold gap. The width of the bottom panels 21 and 31 is slightly less than the width of the top panels 36 and 26, respectively, so that the bottom panels can underlie the top panels without wrinkles. This configuration provides the maximum sheet width product with the most uniform layer concentration with no air gaps. As narrower sheet width products are run at the same stack width, the amount of overlap between the upper and lower sheets can be reduced and/or the center fold gap G between the V-folds can be widened.

Figure 5:
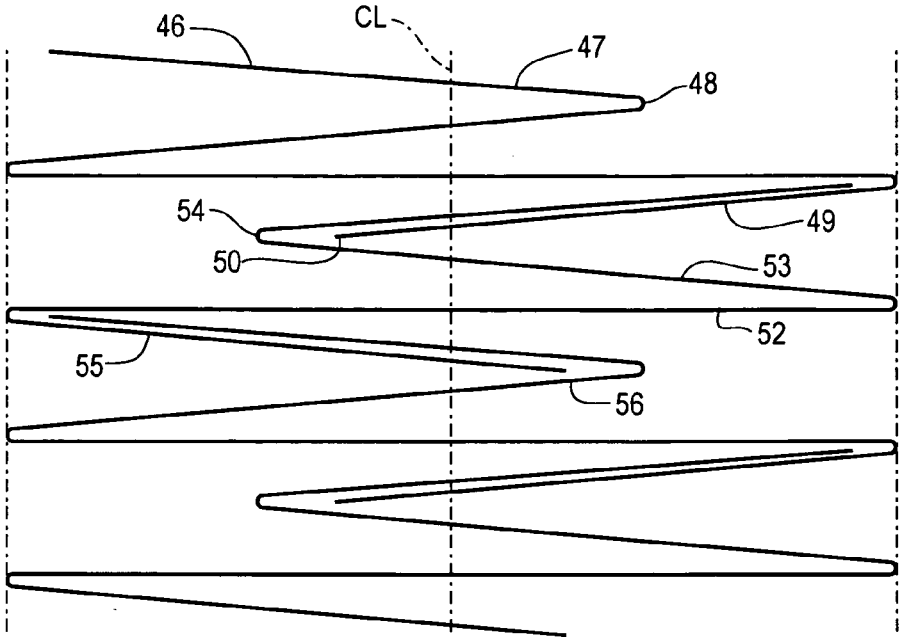
FIGS. 5 through 7 illustrate partial stacks of sheets which are folded in accordance with the invention with different overlap conditions.
Figure 6:
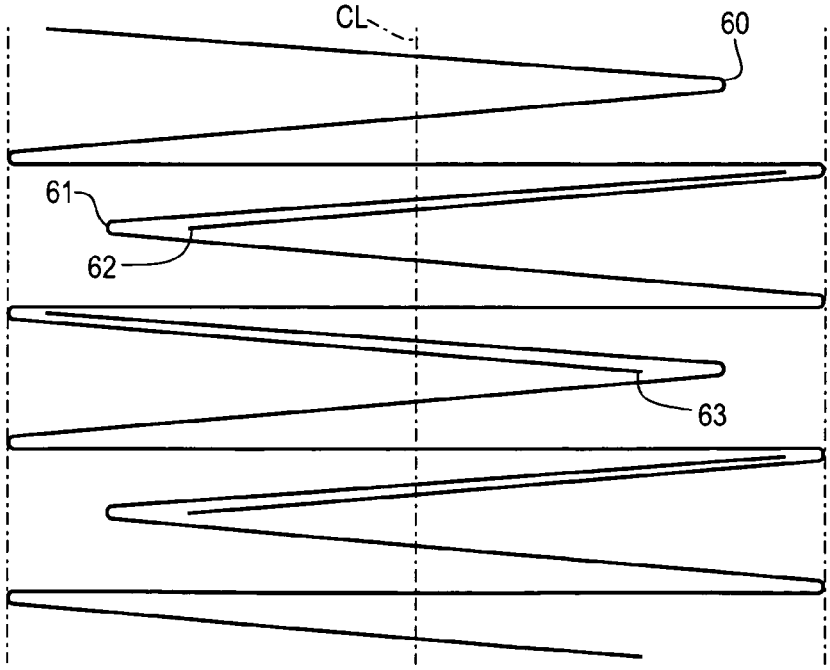
Figure 7:
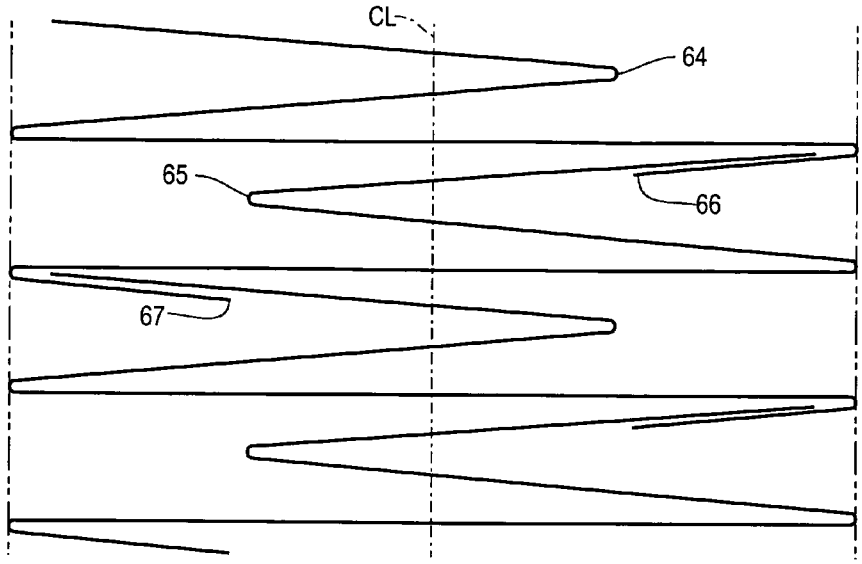

FIGS. 5-7 illustrate alternate embodiments in which wider sheets are folded so that the folded edges of the V folds cross over the center line CL and overlap. In FIG. 5 left facing sheets 46 include a top V-folded portion 47 which includes a folded edge 48 which extends across the center line CL and a bottom panel 49 which terminates in an inner edge 50 which also extends across the center line. Right facing sheets 52 include a top V-folded portion 53 which includes a folded edge 54 which extends across the center line and a bottom panel 55 which terminates in an edge 56 which extends across the center line by slightly less than the extent of the folded edge 54.

In FIG. 6, the folded edges 60 and 61 of the left and right facing sheets extend even farther across the center line than in FIG. 5, and the edges 62 and 63 of the bottom panels extend across the center line by slightly less than the extent of the folded edges 60 and 61.

In FIG. 7 the folded edges 64 and 65 of the left and right facing sheets extend across the center line, but the edges 66 and 67 of the bottom panels do not extend across the center line.

Figure 2:
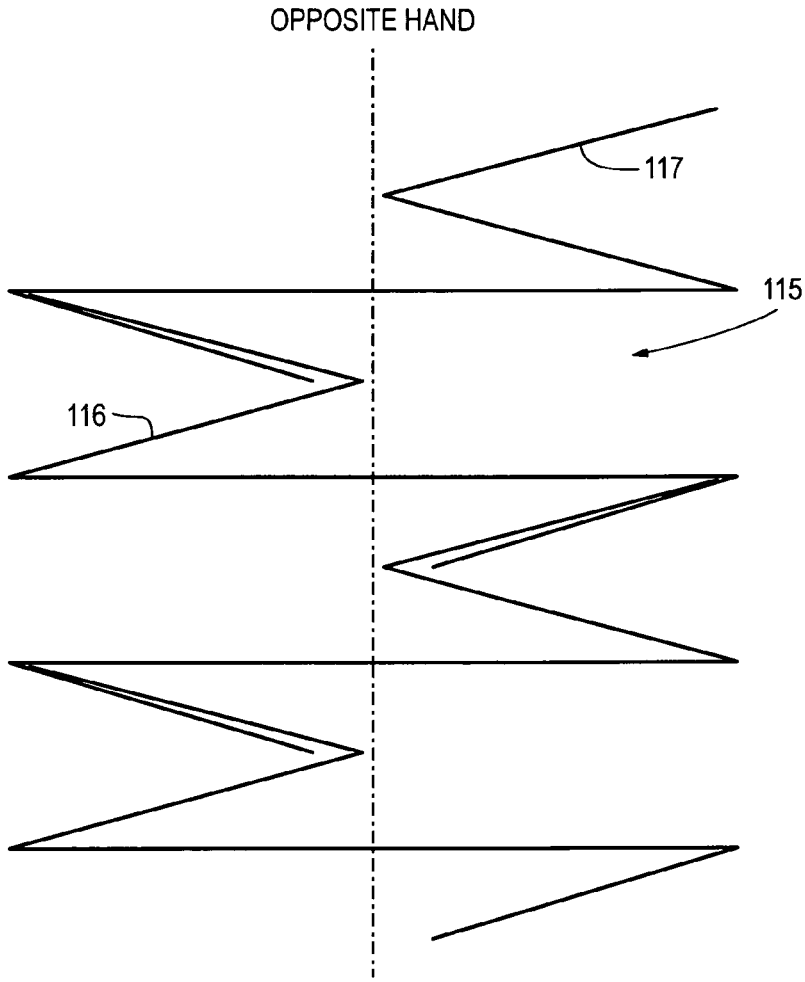
FIG. 2 is a view similar to FIG. 1 with the folded sheets being of opposite hand to the sheets of FIG. 1.

FIG. 2 illustrates a stack 115 which is the same as the stack 15 of FIG. 1 but which is opposite hand to the stack of FIG. 1. In other words, the top sheet 117 is a right facing sheet, and the next sheet 116 is a left facing sheet. The remaining sheets continue to alternate. The sheets of the stacks 15 and 115 are otherwise identical.

Figure 3:
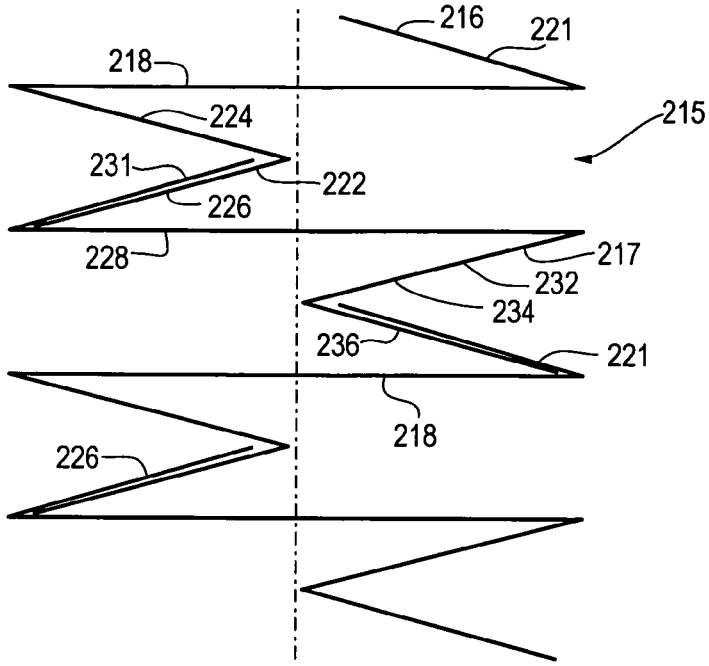
FIG. 3 illustrates the partial stack of FIG. 1 in an inverted position.

FIG. 3 illustrates a stack 215 which is the same as the stack 15 of FIG. 1 but which is inverted from the position of the stack 15. The top sheet 216 is a left facing sheet with a center panel 218, but the second panel 221 extends above the center panel, and the V-folded portion 222 with third and fourth panels 224 and 226 extends below the center panel. The second sheet 217 is a right facing sheet with a center panel 228, a second panel 231 which extends above the center panel, and V-folded portion 232 with third and fourth panels 234 and 236 which extends below the center panel.

The alternating sheets 216 and 217 are interleaved. The second or top panel 231 of each right facing sheet 217 overlies the fourth panel 226 of each left facing sheet 216, and the second or top panel 221 of each left facing sheet 216 overlies the fourth panel 236 of each right facing sheet.

As with the stack 15 of FIG. 1, when the inverted stack 215 is contained in a conventional container or package, the interleaving of the sheets assures that when the top sheet is removed from the container, the next sheet will "pop-up" or move into position for removal. The top panel 221 or 231 of the next sheet will advantageously be partially withdrawn through the opening of the container.

Either the upright stack 15 of FIG. 1 or the inverted stack 215 of FIG. 3 is also suitable for either top or bottom dispensing. When either stack is in a container, the sheets can be withdrawn from either the top or bottom of the container. When a sheet is withdrawn from the container, the interleaving of the sheets will cause the next sheet to be partially withdrawn.

Figure 4:
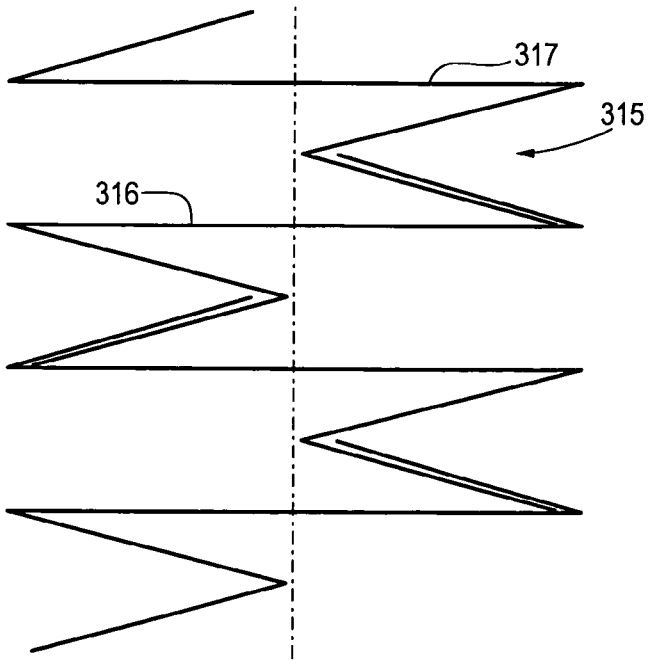
FIG. 4 illustrates the opposite hand partial stack of FIG. 2 in an inverted position.

FIG. 4 illustrates a stack 315 which is the same as the opposite hand stack 115 of FIG. 2 but which is inverted. The top sheet 317 is a right facing sheet, and the next sheet 316 is a left facing sheet.

Figure 8:
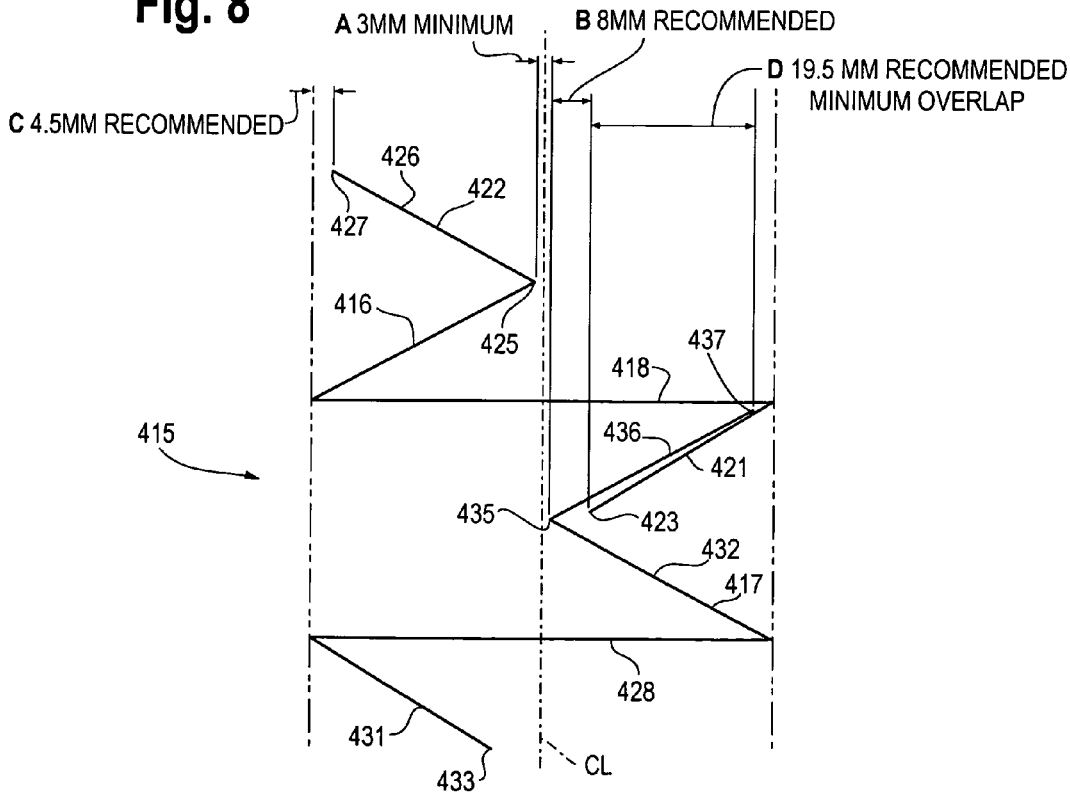
FIG. 8 illustrates a partial stack similar to FIG. 1 with various dimensions labeled.

FIG. 8 illustrates a stack 415 which is similar to the stack 15 of FIG. 1 and includes left facing sheets 416 and right facing sheets 417. The dimension A is the distance or gap between the folded edges 425 and 435 of the V-folded portions 422 and 432. In the preferred embodiments, the dimension A is a minimum of 3 mm.

The dimension B is the distance between the folded edge 435 or 425 of the V-folded portion 432 or 422 of one sheet and the inner edge 432 or 433 of the bottom panel of the other sheet. In the preferred embodiments, the recommended dimension B is 8 mm.

The dimension C is the distance between the outer edges 427 and 437 and the sides of the stack or the side edges of the center panels 418 and 428. In the preferred embodiments, the recommended dimension C is 4.5 mm.

The dimension D is the amount of overlap between the interleaved bottom panels 421 and the top panels 436 and the interleaved bottom panels 431 and the top panels 426. In the preferred embodiments, the recommended dimension D is a minimum of 19.5 mm. The amount of overlap to create good dispensing depends on variables such as the substrate or material of the sheets, the nature of any lotion or moistening material on the sheets, the size and shape of the opening in the container, etc. Such issues are generally decided by the manufacturer of the stack.

Figure 9:
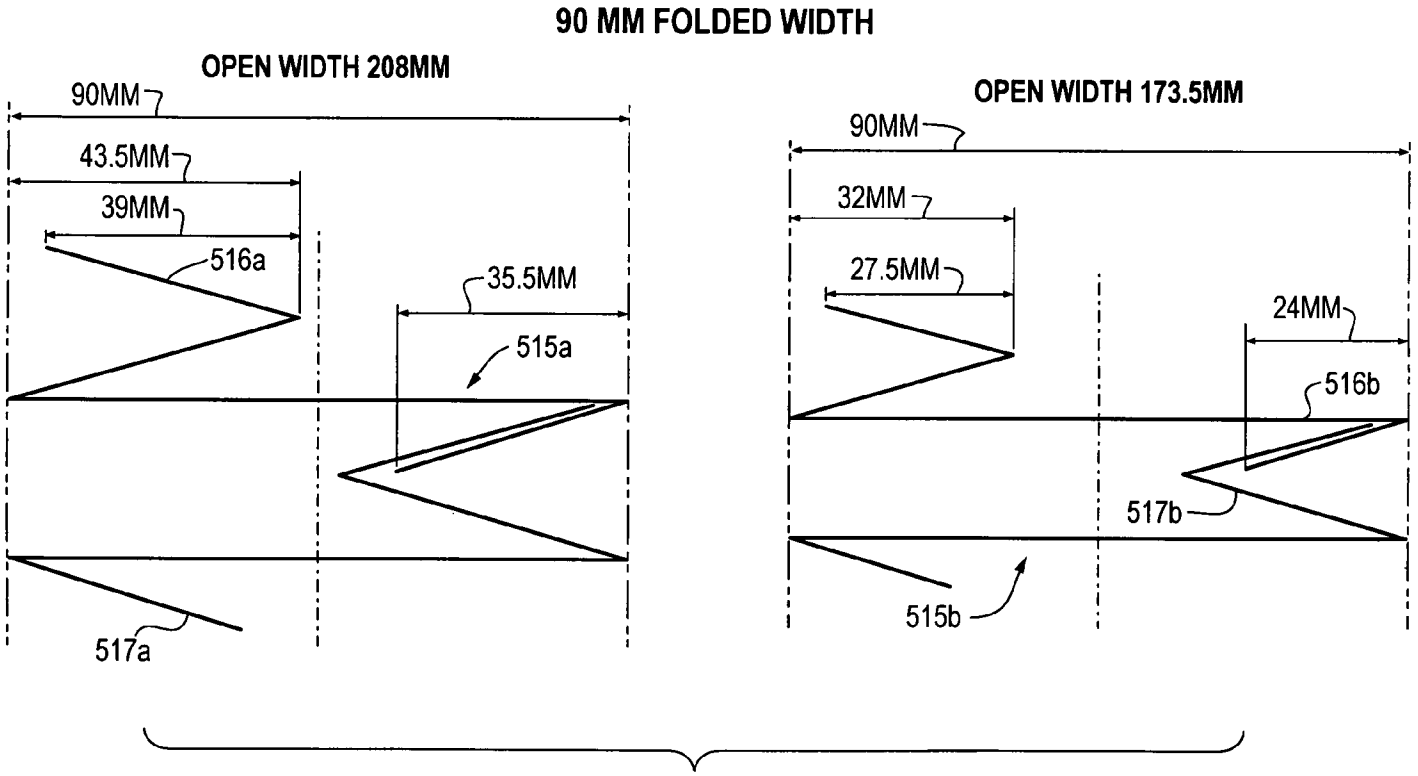
FIGS. 9 through 11 illustrate how sheets of various widths can be folded in accordance with the invention to form relatively narrow stack widths.
Figure 10:
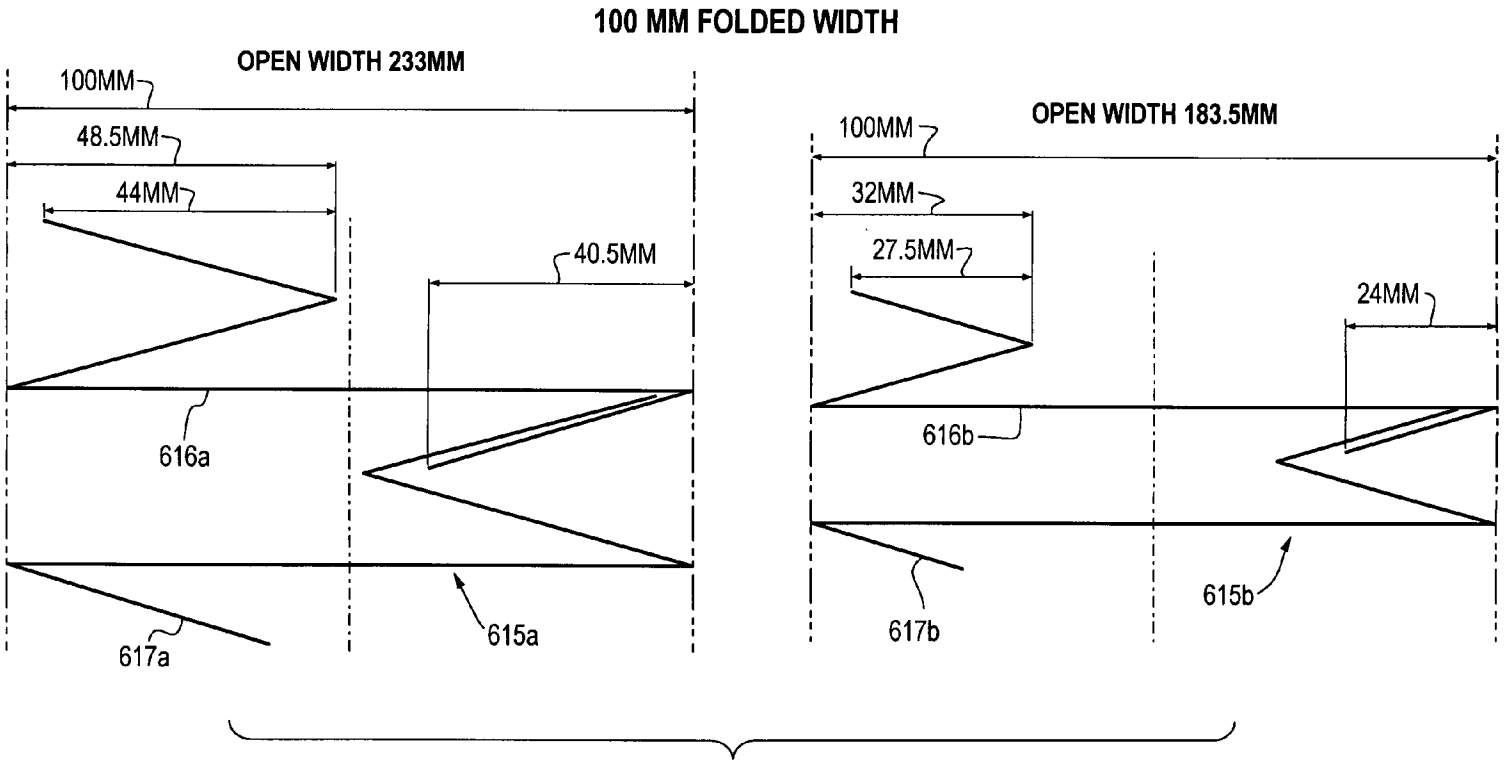
Figure 11:
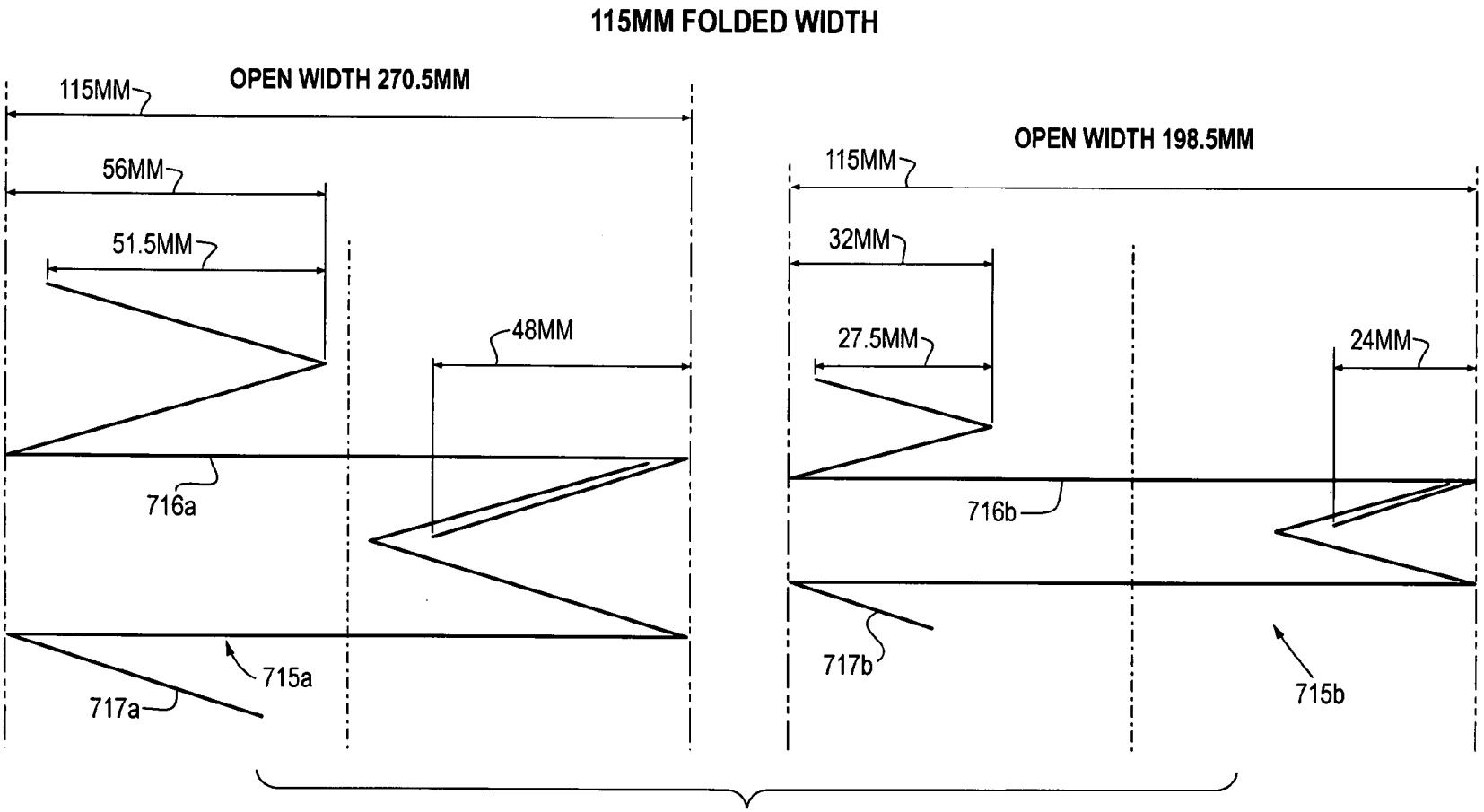

FIGS. 9-11 illustrate how sheets of various wide and medium widths can be folded into stacks having relatively narrow widths.

The stacks 515*a* and 515*b* of FIG. 9 are each 90 mm wide. The sheets 516*a* and 517*a* of stack 515*a* have an open width of 208 mm, and the sheets 516*b* and 517*b* of stack 515*b* have an open width of 173.5 mm. The dimensions of the various folded portions of the sheets are indicated.

The stacks 615*a* and 615*b* of FIG. 10 are each 100 mm wide. The sheets 616*a* and 617*a* of stack 615*a* have an open width of 233 mm, and the sheets 616*b* and 617*b* of stack 615*b* have an open width of 183.5 mm.

The stacks 715*a* and 715*b* of FIG. 11 are each 115 mm wide. The sheets 716*a* and 717*a* of stack 715*a* have an open width of 270.5 mm, and the sheets 716*b* and 717*b* of stack 715*b* have an open width of 193.5 mm.

In another embodiment, sheets having an open width of 10 inches were folded to a stack width of 4.25 inches.

Figure 12:
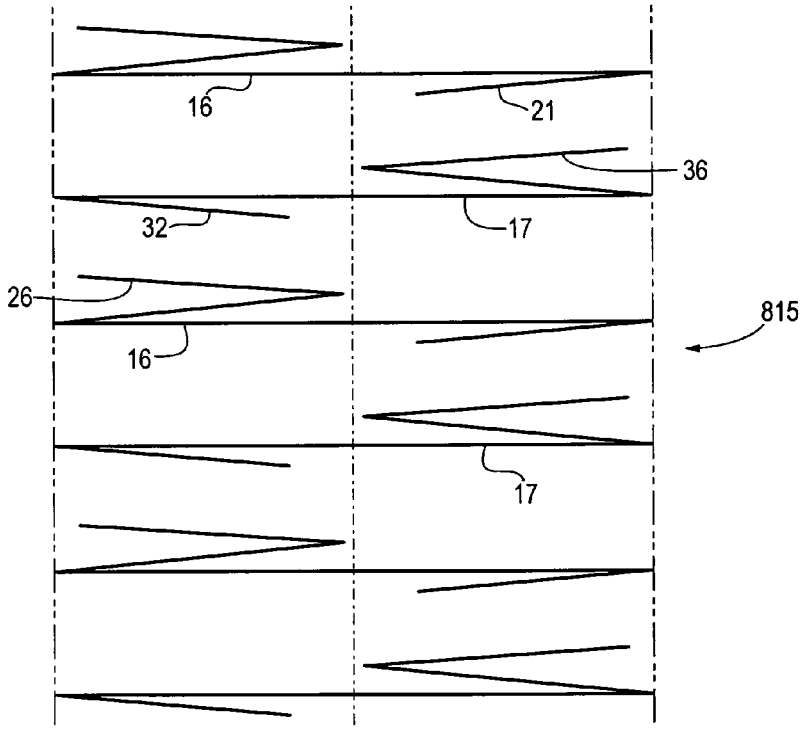
FIG. 12 is a view of a partial stack similar to FIG. 1 in which the sheets are not interleaved.

FIG. 12 illustrates a stack 815 which is formed from left facing sheets 16 and right facing sheets 17 which are not interleaved or interfolded. The bottom panels 21 of each left facing sheet overlies the top panel 36 of the next right facing sheet, and the bottom panel 31 of each right facing sheet overlies the top panel 26 of the next left facing sheet. Removing the top sheet does not cause the next sheet to "pop-up."

The advantages of the inventive J-Z fold include:

- dispensing is better than The V-Z fold of U.S. Pat. No. 6,168,848 or the fold of U.S. Pat. No. 5,497,903 since all top sheets are of equal width (in the preferred embodiment);
- dispensing can be from either end of the stack for top or bottom dispensing;
- because dispensing can be from either end of the stack, the stack does not need to be turned over to feed into some flow wrappers or containers;
- the narrower folded width reduces packaging materials and provides a more attractive, less bulky package and narrower shelf space;
- the stack can have higher bulk; the sheet count of the stack can be reduced without affecting the height of the stack.

FIGS. 13-18 illustrate folding boards for forming the right and left facing folded sheets illustrated in the previous figures.

Figure 13:
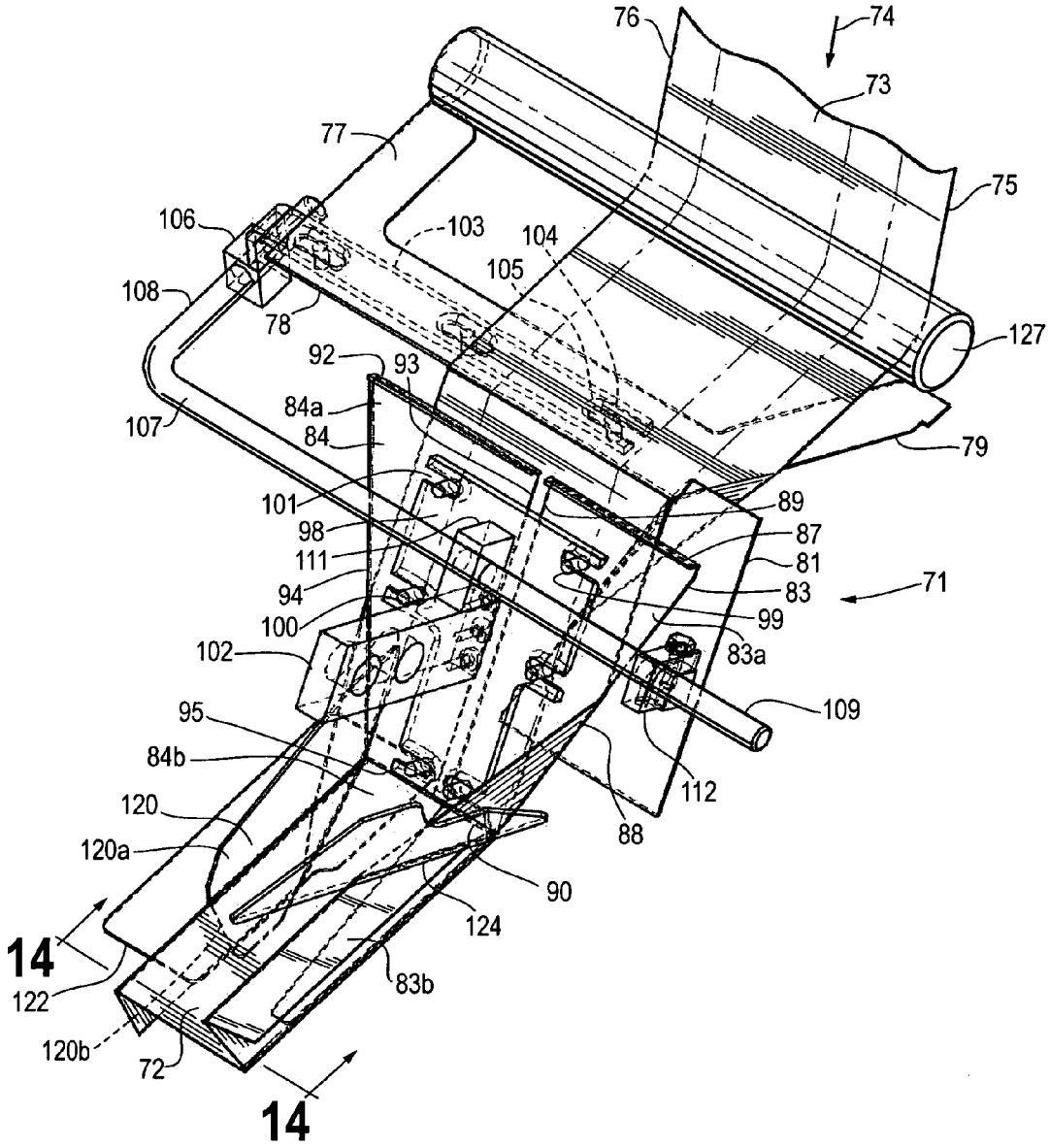
FIG. 13 is a perspective view of a folding board for forming the right facing sheets of the previous figures.

FIG. 13 illustrates a folding board 71 for forming a right facing folded sheet 72 from an elongated web 73 of appropriate material such as paper, non-woven, etc. The web is advanced in the direction of the arrow 74 and includes right and left side edges 75 and 76.

Figure 15:
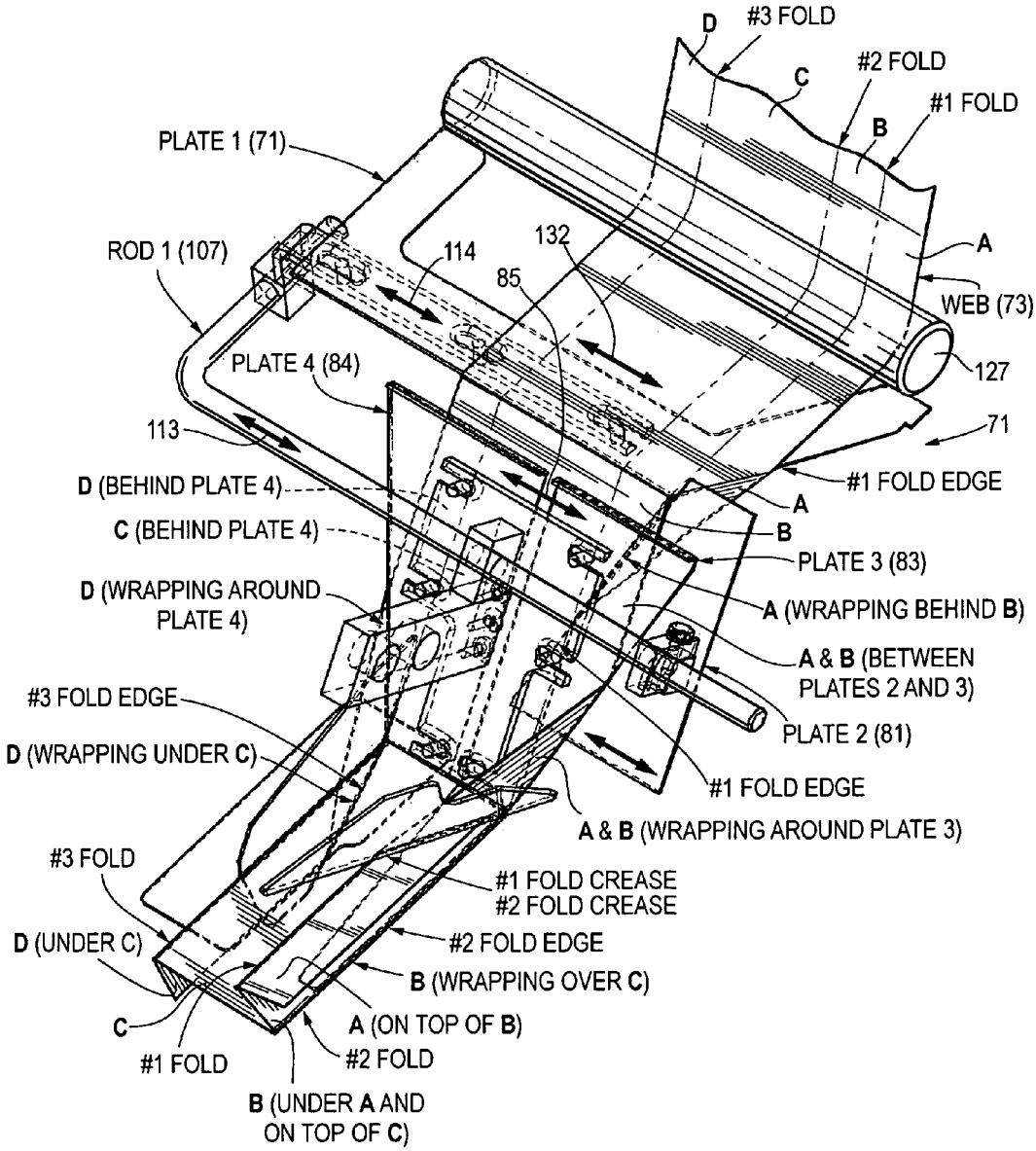
FIG. 15 is a view similar to FIG. 13 which is annotated to illustrate the folding edges and other parts of the folding board, web, and folded sheet.

FIG. 15 illustrates the same folding board, web, and folded sheet material with annotations for the various parts of the folding board, web, and sheet.

Referring to FIGS. 13 and 15, the folding board 71 includes a horizontal first plate 77 (Plate 1) which has a front edge 78 which extends transversely to the web and a right side edge 79 which extends angularly with respect to the right edge 76 of the web. A second plate 81 (Plate 2) extends angularly downwardly from the first plate 77. The first plate 77 and the second plate 81 are independently mounted on the frame of a conventional folding machine (not shown).

A third plate 83 (Plate 3) and a fourth plate 84 (Plate 4) are mounted in front of second plate 81 for sliding movement in the direction of arrow 85. The third plate 83 includes a generally trapezoidally shaped portion 83*a* and a forwardly extending horizontal portion 83*b*. The trapezoidal portion 83*a* includes an upper edge 87 which extends transversely to the web, a right side edge 88 which extends angularly with respect to the right edge of the web, a left side edge 89 which extends parallel to the side edges of the web, and a bottom edge 90.

The fourth plate 84 similarly includes a trapezoidal portion 84*a* and a forwardly extending horizontal bottom portion 84*b*. The trapezoidal portion includes an upper edge 92, right and left side edges 93 and 94, and bottom edge 95.

The third and fourth plates 83 and 84 are slidably mounted on a mounting plate 98 by three pins 99 on plate 83 and three pins 100 on plate 84 and six slots 101 in the mounting plate 98. The mounting plate 98 is secured to the frame of the folding machine by a mounting block 102 which is attached to the mounting plate.

The first plate 77 is supported on a support plate 103, and the first plate 77 can move on the support plate 103 in a transverse direction relative to the web (cross machine direction) by means of bolts 104 on the first plate and slots 105 in the support plate 103. Nuts (not shown) are threaded onto the bolts 104 for clamping the first plate 77 against the support plate 103. The left end of the support plate 103 is supported by a mounting block 106.

An L-shaped rod or link 107 includes a short leg 108 and a long leg 109. The short leg 108 is attached to the left side of the first plate 77 and the support plate 103 by the mounting block 106. The long leg 109 of the rod is slidably supported by a block or bushing 111 which is attached to the fourth plate 85. The end of the long leg 109 is attached to the second plate 81 by a mounting block 112. The long leg 109 of the rod extends transversely to the web, and the long leg can be adjusted in the direction of the arrow 113 (cross machine direction) by sliding the long leg through the opening in the support block 111. Adjusting the rod 107 will move the first plate 77 and the second plate 81 simultaneously.

An L-shaped left plow 120 includes a vertically extending portion 120*a* and a horizontally extending portion 120*b*. The plow 120 is supported at two points by the fourth plate 84 and by the mounting block 102. The bottom portion 120*b* extends parallel to the bottom portion 84*b* of the fourth plate 84 and is spaced above the bottom portion 84*b*

A horizontal plate 122 extends parallel to the bottom portion 84*b* of the fourth plate 84 and to the bottom portion 120*b* of the plow 120 and is spaced below the bottom portion 84*b* of the fourth plate 84. The plate 122 is supported by a bracket which is attached to the plow 120.

A right plow 124 extends angularly with respect to the web and is spaced above the bottom portion 83*b* of the third plate 83. The plow 124 is supported by a shaft which is connected to the mounting block 102.

Figure 14:
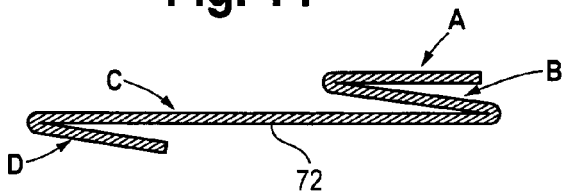
FIG. 14 is a sectional view taken along the line 14-14 of FIG. 13.

FIG. 14 is a sectional view of the right facing folded web 72 which is formed by the folding board 71. The right facing folded web includes four panels A, B, C, and D. After the web is folded, it is interleaved with one or two left facing folded webs in a manner well known to those skilled in the art, and a plurality of interleaved webs are cut to form a stack of folded sheets.

A turning bar 127 is mounted on the folding machine above the first plate 77. The web 73 is fed under the turning bar and over the front edge 78 and right side edge 79 of the first plate 77. Referring to the upper right portion of FIG. 15, the portions of the web which will be folded to form the four panels A, B, C, and D are indicated. The three fold lines along which the web will be folded to form the four panels are indicated as #1 fold, #2 fold, and #3 fold. The central panel C of the web is not folded by the folding board.

As the web advances over the front edge 78 and the right side edge 79 of the first plate 77, the right side of the web is folded downwardly by the right side edge 79 to form panel A. The web is then advanced between the second plate 81, which completes the fold of panel A, and the third and fourth plates 83 and 84. The once-folded right portion of the web is folded again as it advances over the angular right edge 88 of the third plate 83 to form the panel B, and the panels A and B are positioned above the central panel C. The panels A and B and the adjacent portion of the central panel C are advanced above the bottom portion 83*b* of the third plate 83 and below the bottom edge of the right plow 124. The right plow creases the #1 and #2 fold lines which form panels A and B.

As the left edge of the web is advanced over the angular left side edge 94 of the fourth plate 84, the left side of the web is folded by the side edge 94 and panel D is formed. Panel D and the adjacent portion of the central panel C are advanced above the bottom portion 120*b* of the left plow 120.

Figure 16:
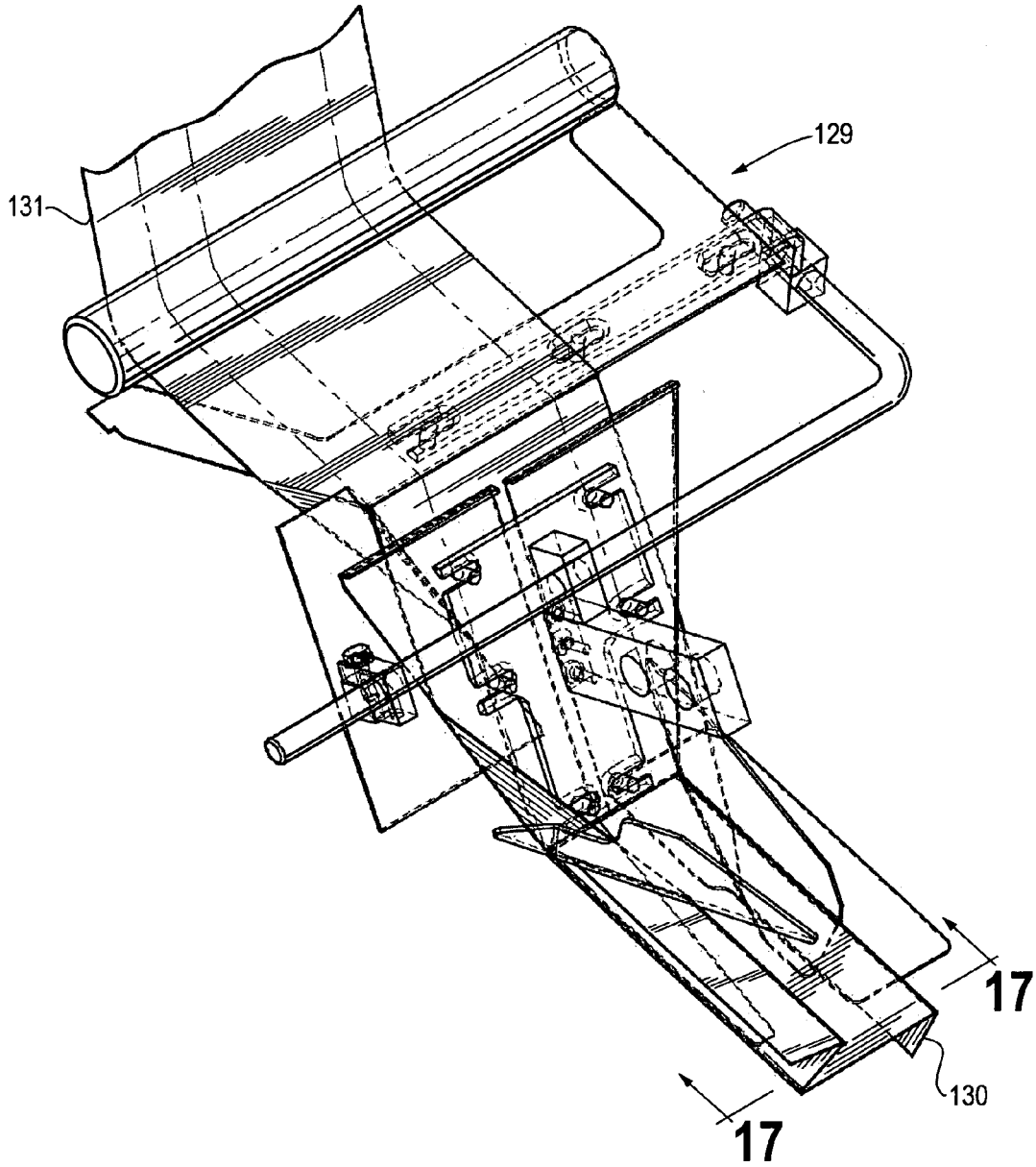
FIG. 16 is a perspective view of a folding board for forming the left facing sheets of the previous figures.
Figure 17:
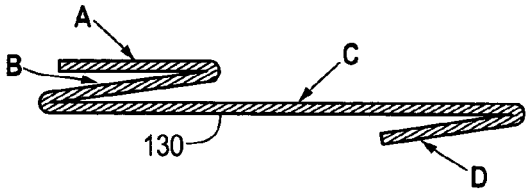
FIG. 17 is a sectional view taken along the line 17-17 of FIG. 16.
Figure 18:
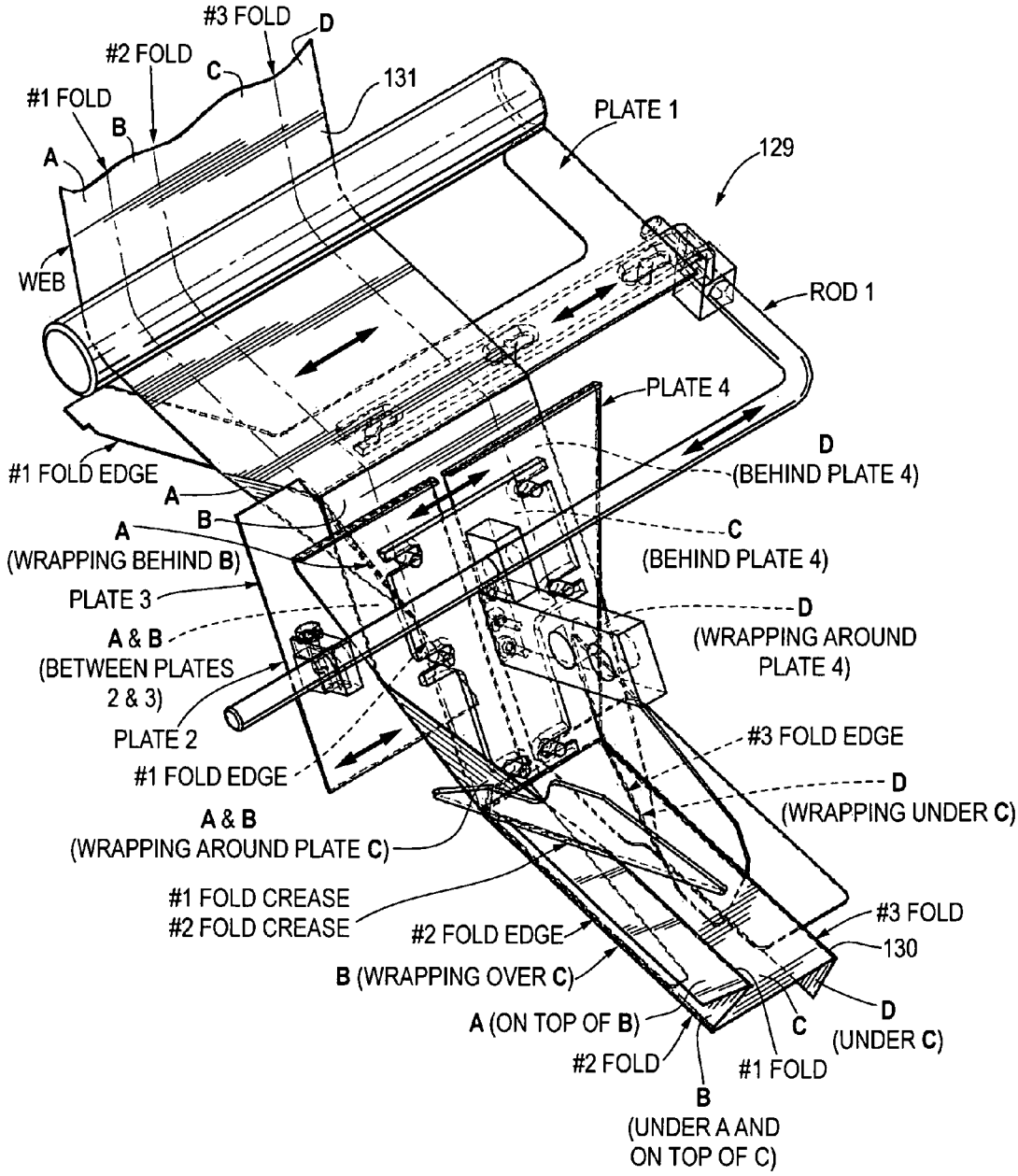
FIG. 18 is a view similar to FIG. 16 which is annotated to illustrate the folding edges and other parts of the folding board, web, and folded sheet.

FIGS. 16 and 18 illustrate a folding board 129 for forming a left facing folded sheet 130 from a web 131. The folding board 129 is the mirror image of the folding board 71 and operates in the same way.

The folding boards 71 and 129 facilitate adjustments to the widths of the four panels A, B, C, and D of the folded sheets. Referring to FIG. 15, shifting the web 73 transversely either right or left in the direction of arrow 132 (cross machine direction) will change the widths of panels A and D relative to each other.

Adjusting the first plate 77 and the second plate 81 relative to the web by moving the rod 107 in the direction of arrow 113 will change the width of panel A.

The first plate 77 can be adjusted relative to the second plate 81 by loosening the nuts on bolts 104 and sliding the first plate 77 over the support plate 103 in the direction of arrow 114.

Adjusting the third plate 83 relative to the web by moving the third plate in the direction of the arrow 85 will change the widths of panels B and C. Similarly, adjusting the fourth plate 84 in the direction of the arrow 85 will change the widths of panels D and C.

The adjustable folding boards also permit adjustments to achieve consistency of the final product if the web stretches during processing by the folding machine.

While in the foregoing specification a detailed description of specific embodiments was set forth for the purpose of illustration, it will be understood that many of the details described herein can be varied considerably by those skilled in the art without departing from the spirit and scope of the invention.

I claim:

1. A stack of folded sheets comprising first and second groups of folded sheets, each of the sheets of the first group including a center panel having right and left outer edges which define the width of the center panel, a second panel which extends inwardly from the right edge of the center panel and terminates in a left inner edge, and a V-shaped portion extending from the left edge of the center panel and including third and fourth panels, the third panel extending inwardly from the left edge of the center panel and terminating in a right inner edge, the fourth panel extending outwardly from the right edge of the third panel and terminating in a left outer edge, each of the second, third, and fourth panels having a width less than the width of the center panel, each of the sheets of the second group including a center panel having right and left outer edges which define the width of the center panel, a second panel which extends inwardly from the left edge of the center panel and terminates in a right inner edge, and a V-shaped portion extending from the right edge of the center panel and including third and fourth panels, the third panel extending inwardly from the right edge of the center panel and terminating in a left inner edge, the fourth panel extending outwardly form the left edge of the third panel and terminating in a right outer edge, each of the second, third, and fourth panels having a width less than the width of the center panel, said sheets being arranged so that the second panel of each sheet of each group except the bottom sheet of the stack is adjacent a fourth panel of a sheet of the other group.

2. The stack of claim 1 in which the center panels of the first and second groups overlie each other with the right and left edges thereof generally aligned, the width of the center panels defining the width of the stack.

3. The stack of claim 1 in which the second panel of each sheet of each group except the bottom sheet of the stack is interleaved with a fourth panel of a sheet of the other group.

4. The stack of claim 1 in which the second panel of each sheet extends below the center panel of the sheet and the V-shaped portion of each sheet extends above the center panel of the sheet.

5. The stack of claim 1 in which the second panel of each sheet extends above the center panel of the sheet and the V-shaped portion of each sheet extends below the center panel of the sheet.

6. The stack of claim 1 in which the width of each of the second, third, and fourth panels of each sheet is less than half of the width of the center panel of the sheet.

7. The stack of claim 1 in which the inner edge of the second panel of each sheet does not overlap the inner edge of said third panel of the sheet.

8. The stack of claim 1 in which the width of the second panel of each sheet does not exceed the widths of the third and fourth panels of the sheet.

9. A stack of folded sheets comprising first and second groups of folded sheets, each of the sheets of the first group including a center panel having right and left outer edges, a second panel which extends inwardly from the right edge of the center panel and terminates in a left inner edge, and a V-shaped portion extending from the left edge of the center panel and including third and fourth panels, the third panel extending inwardly from the left edge of the center panel and terminating in a right inner edge, the fourth panel extending outwardly from the right edge of the third panel and terminating in a left outer edge, each of the sheets of the second group including a center panel having right and left outer edges, a second panel which extends inwardly from the left edge of the center panel and terminates in a right inner edge, and a V-shaped portion extending from the right edge of the center panel and including third and fourth panels, the third panel extending inwardly from the right edge of the center panel and terminating in a left inner edge, the fourth panel extending outwardly form the left edge of the third panel and terminating in a right outer edge, said sheets being arranged so that the second panel of each sheet of each group except the bottom sheet of the stack is adjacent a fourth panel of a sheet of the other group, the second panel of each sheet of each group except the bottom sheet of the stack being interleaved with a fourth panel of a sheet of the other group, the inner edge of the second panel of each sheet not overlapping the inner edge of said third panel of the sheet.

10. A stack of folded sheets comprising first and second groups of folded sheets, each of the sheets of the first group including a center panel having right and left outer edges, a second panel which extends inwardly from the right edge of the center panel and terminates in a left inner edge, and a V-shaped portion extending from the left edge of the center panel and including third and fourth panels, the third panel extending inwardly from the left edge of the center panel and terminating in a right inner edge, the fourth panel extending outwardly from the right edge of the third panel and terminating in a left outer edge, each of the sheets of the second group including a center panel having right and left outer edges, a second panel which extends inwardly from the left edge of the center panel and terminates in a right inner edge, and a V-shaped portion extending from the right edge of the center panel and including third and fourth panels, the third panel extending inwardly from the right edge of the center panel and terminating in a left inner edge, the fourth panel extending outwardly form the left edge of the third panel and terminating in a right outer edge, said sheets being arranged so that the second panel of each sheet of each group except the bottom sheet of the stack is adjacent a fourth panel of a sheet of the other group, the second panel of each sheet of each group except the bottom sheet of the stack being interleaved with a fourth panel of a sheet of the other group, the width of each of the second panels not exceeding the widths of each of the third and fourth panels.

11. A stack of folded sheets comprising first and second groups of folded sheets, each of the sheets of the first group including a center panel having right and left outer edges which define the width of the center panel, a second panel which extends inwardly from the right edge of the center panel and terminates in a left inner edge, and a V-shaped portion extending from the left edge of the center panel and including third and fourth panels, the third panel extending inwardly from the left edge of the center panel and terminating in a right inner edge, the fourth panel extending outwardly from the right edge of the third panel and terminating in a left outer edge, each of the second, third, and fourth panels having a width less than the width of the center panel, each of the sheets of the second group including a center panel having right and left outer edges which define the width of the center panel, a second panel which extends inwardly from the left edge of the center panel and terminates in a right inner edge, and a V-shaped portion extending from the right edge of the center panel and including third and fourth panels, the third panel extending inwardly from the right edge of the center panel and terminating in a left inner edge, the fourth panel extending outwardly form the left edge of the third panel and terminating in a right outer edge, each of the second, third, and fourth panels having a width less than the width of the center panel, said sheets being arranged so that the fourth panel of each sheet of each group except the bottom sheet of the stack is adjacent a second panel of a sheet of the other group.

12. The stack of claim 11 in which the center panels of the first and second groups overlie each other with the right and left edges thereof generally aligned, the width of the center panels defining the width of the stack.

13. The stack of claim 11 in which the second panel of each sheet of each group except the bottom sheet of the stack is interleaved with a fourth panel of a sheet of the other group.

14. The stack of claim 11 in which the second panel of each sheet extends above the center panel of the sheet and the V-shaped portion of each sheet extends below the center panel of the sheet.

15. The stack of claim 11 in which the width of each of the second, third, and fourth panels of each sheet is less than half of the width of the center panel of the sheet.

16. The stack of claim 11 in which the inner edge of the second panel of each sheet does not overlap the inner edge of said third panel of the sheet.

17. The stack of claim 11 in which the width of the second panel of each sheet does not exceed the widths of the third and fourth panels of the sheet.

18. A stack of folded sheets comprising first and second groups of folded sheets, each of the sheets of the first group including a center panel having right and left outer edges, a second panel which extends inwardly from the right edge of the center panel and terminates in a left inner edge, and a V-shaped portion extending from the left edge of the center panel and including third and fourth panels, the third panel extending inwardly from the left edge of the center panel and terminating in a right inner edge, the fourth panel extending outwardly from the right edge of the third panel and terminating in a left outer edge, each of the sheets of the second group including a center panel having right and left outer edges, a second panel which extends inwardly from the left edge of the center panel and terminates in a right inner edge, and a V-shaped portion extending from the right edge of the center panel and including third and fourth panels, the third panel extending inwardly from the right edge of the center panel and terminating in a left inner edge, the fourth panel extending outwardly form the left edge of the third panel and terminating in a right outer edge, said sheets being arranged so that the fourth panel of each sheet of each group except the bottom sheet of the stack is adjacent a second panel of a sheet of the other group, the second panel of each sheet of each group except the bottom sheet of the stack being interleaved with a fourth panel of a sheet of the other group, the inner edge of the second panel of each sheet not overlapping the inner edge of said third panel of the sheet.

19. A stack of folded sheets comprising first and second groups of folded sheets, each of the sheets of the first group including a center panel having right and left outer edges, a second panel which extends inwardly from the right edge of the center panel and terminates in a left inner edge, and a V-shaped portion extending from the left edge of the center panel and including third and fourth panels, the third panel extending inwardly from the left edge of the center panel and terminating in a right inner edge, the fourth panel extending outwardly from the right edge of the third panel and terminating in a left outer edge, each of the sheets of the second group including a center panel having right and left outer edges, a second panel which extends inwardly from the left edge of the center panel and terminates in a right inner edge, and a V-shaped portion extending from the right edge of the center panel and including third and fourth panels, the third panel extending inwardly from the right edge of the center panel and terminating in a left inner edge, the fourth panel extending outwardly form the left edge of the third panel and terminating in a right outer edge, said sheets being arranged so that the fourth panel of each sheet of each group except the bottom sheet of the stack is adjacent a second panel of a sheet of the other group, the second panel of each sheet of each group except the bottom sheet of the stack being interleaved with a fourth panel of a sheet of the other group, the width of each of the second panels not exceeding the widths of each of the third and fourth panels.

* * * * *